US006595180B2

(12) United States Patent
Thompson et al.

(10) Patent No.: US 6,595,180 B2
(45) Date of Patent: Jul. 22, 2003

(54) IDLE SHUTDOWN OVERRIDE WITH DEFEAT PROTECTION

(75) Inventors: Marleen Frances Thompson, Sterling Heights, MI (US); Ian Daniel McKenzie, Canton, MI (US); Richard M. Avery, Jr., West Bloomfield, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/996,286

(22) Filed: Nov. 28, 2001

(65) Prior Publication Data

US 2002/0033157 A1 Mar. 21, 2002

Related U.S. Application Data

(63) Continuation of application No. 09/520,117, filed on Mar. 6, 2000, now Pat. No. 6,363,906.

(51) Int. Cl.[7] ..... F02N 11/08
(52) U.S. Cl. ..... 123/198 DB; 123/198 DC
(58) Field of Search ..... 123/198 DB, 198 DC

(56) References Cited

U.S. PATENT DOCUMENTS

| | | | | |
|---|---|---|---|---|
| 4,006,723 A | | 2/1977 | Schmidli | |
| 4,050,436 A | | 9/1977 | Crabtree | |
| 4,286,683 A | * | 9/1981 | Zeigner et al. | 123/179.4 |
| 4,312,310 A | * | 1/1982 | Chivilo' et al. | 123/198 DB |
| 4,347,817 A | | 9/1982 | Muller | |
| 4,419,866 A | | 12/1983 | Howland | |
| 4,421,075 A | * | 12/1983 | Mandel | 123/142.5 R |
| 4,482,812 A | * | 11/1984 | Hori et al. | 123/179.4 |
| 4,534,326 A | | 8/1985 | Bowcott | |
| 4,694,807 A | * | 9/1987 | Mori | 123/198 DB |
| 4,741,164 A | * | 5/1988 | Slaughter | 123/198 DB |
| 4,878,465 A | | 11/1989 | Hanson et al. | |
| 5,072,703 A | * | 12/1991 | Sutton | 123/179.4 |
| 5,140,826 A | | 8/1992 | Hanson et al. | |
| 5,186,015 A | | 2/1993 | Roehrich et al. | |
| 5,222,469 A | * | 6/1993 | Sutton | 123/198 DC |
| 5,275,011 A | | 1/1994 | Hanson et al. | |

* cited by examiner

*Primary Examiner*—Henry C. Yuen
*Assistant Examiner*—Jason Benton
(74) *Attorney, Agent, or Firm*—Brooks & Kushman P.C.

(57) ABSTRACT

A system and method for controlling a compression ignition internal combustion engine having an electronic control module with an idle shutdown feature to automatically stop the engine after idling for a period of time include determining whether the engine is being loaded and overriding the idle shutdown feature to keep the engine running when the engine is being loaded. In one embodiment, the present invention includes monitoring operating conditions to determine that the vehicle is stationary, monitoring the engine to determine the engine is idling, initiating a timer/counter to provide an indication of idling time, determining that the engine is operating in an auxiliary power mode, determining engine load, and automatically stopping the engine when the idling time exceeds a first threshold and the engine load is less than a second threshold. The present invention makes it more difficult for engine operators to defeat the idle shutdown feature by detecting current engine operating conditions to verify that the selected operating mode is consistent with current engine operating conditions.

39 Claims, 3 Drawing Sheets

IDLE SHUTDOWN OVERRIDE WITH DEFEAT PROTECTION

CROSS-REFERENCE TO RELATED APPLICATION

This application is a continuation of U.S. application Ser. No. 09/520,117 filed Mar. 6, 2000, now U.S. Pat. No. 6,363,906 B1, the disclosure of which is hereby incorporated by reference.

TECHNICAL FIELD

The present invention relates to a system and method for controlling an engine including an idle shutdown feature.

BACKGROUND ART

Diesel engines have a wide variety of applications including passenger vehicles, marine vessels, earth-moving and construction equipment, stationary generators, and on-highway trucks, among others. Electronic engine controllers provide a wide range of flexibility in tailoring engine performance to a particular application without significant changes to engine hardware. While diesel fuel is often less expensive, and diesel engines are more efficient than gasoline powered engines, diesel engine applications often require running the engine continuously over long periods of time.

In many diesel engine applications, the engine operator does not own the engine and therefore does not pay for the fuel or engine maintenance. The operator often seeks maximum power whereas the owner strives to achieve maximum fuel economy. To further improve fuel efficiency, manufacturers have developed and implemented various electronic engine control features which attempt to optimize fuel economy while maintaining acceptable (although often not maximum) power for the particular application and operating conditions. Furthermore, features have been provided which allow the engine owner to impose operational limits on the engine operator to promote safety and/or fuel economy. As such, operators may tamper with the engine sensors or actuators to "trick" the engine controller and circumvent or defeat various engine control features designed to improve fuel economy so the operator can obtain more power or speed, or keep the engine running.

Idle shutdown is an electronic engine control feature designed to prevent unnecessary engine idling with resulting lower fuel economy. On-highway truck drivers often leave the engine idling for extended periods of time for various reasons such as avoiding difficulty in restarting the engine or keeping the vehicle warm, for example. In one implementation of an idle shutdown feature, when the engine controller determines that the vehicle is parked and the engine has been idling for some period of time, the engine controller automatically stops the engine. The idle shutdown includes an automatic override feature to prevent the engine from being automatically stopped when the engine is being used to drive auxiliary equipment in power take-off (PTO) mode. For example, the engine may be running a generator to cool a refrigerated truck, driving a pump on a fire engine, powering hydraulics for a crane or construction equipment, etc. As such, drivers may "trick" the engine controller by placing the engine in a mode, such as PTO mode, which automatically overrides the idle shutdown feature even though the engine is not actually being used to drive any auxiliary equipment.

DISCLOSURE OF INVENTION

The present invention includes a method for controlling a compression ignition engine having an electronic control module with an idle shutdown feature to automatically stop the engine after idling for a period of time. The method includes determining whether the engine is being loaded and overriding the idle shutdown feature to keep the engine running when the engine is being loaded. In one embodiment of the present invention, the engine controller determines whether the current operating conditions are consistent with an operator selected operating mode, such as PTO, to determine whether to override the idle shutdown feature and keep the engine running.

The present invention is implemented in an embodiment which controls a compression ignition internal combustion engine installed in a vehicle to reduce unnecessary idling. The engine controller monitors operating conditions to determine that the vehicle is stationary, monitors the engine to determine the engine is idling, initiates a timer/counter to provide an indication of engine idling time, determines that the engine is operating in an auxiliary power mode, determines engine load, and automatically stops the engine when the idling time exceeds a first threshold and the engine load is less than a second threshold.

The present invention includes a number of advantages relative to prior art idle shutdown features. For example, the present invention provides an idle shutdown feature with automatic override which is less susceptible to improper use by engine operators and should therefore result in improved fuel economy in certain circumstances. The present invention automatically determines whether the engine operating conditions are consistent with a special operating mode, such as PTO, to enable the automatic idle shutdown override. In one embodiment, the present invention provides a system and method for determining the current engine load prior to overriding the idle shutdown feature so that the engine is not unintentionally shutdown. The present invention makes it more difficult for operators to defeat the idle shutdown feature and keep the engine running by selecting an operating mode, such as PTO, which would otherwise override the idle shutdown feature, unless the engine operating conditions indicate the mode selection is proper. Increased use of the idle shutdown feature by detecting attempts to defeat it may have many additional benefits associated with the reduction in unnecessary idling, such as reduced engine wear, reduced emissions, and reduced maintenance requirements such as oil changes and the like.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
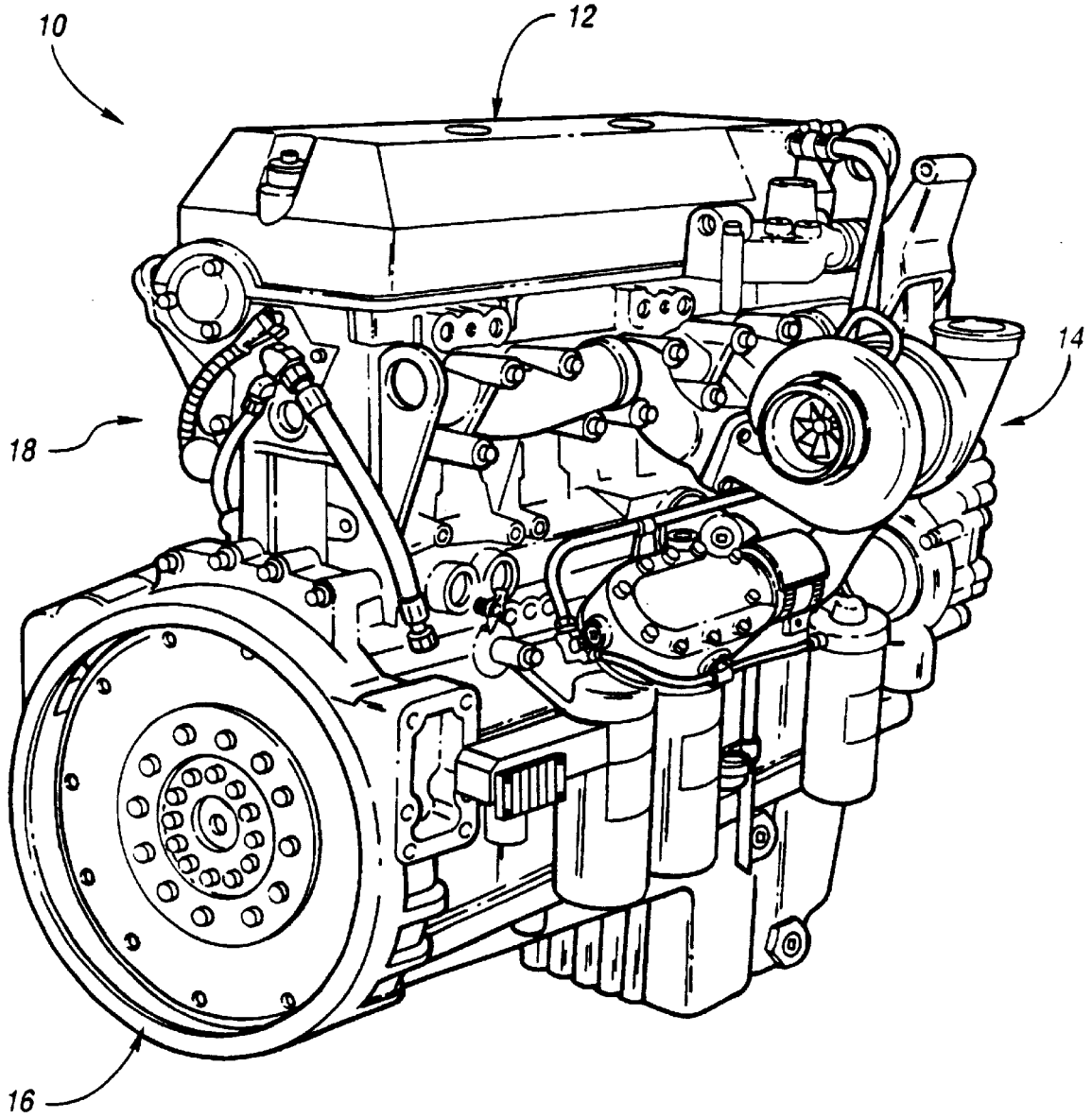
FIG. 1 illustrates a compression ignition engine incorporating various features of the present invention.

FIG. 1 is a perspective view of a compression-ignition internal combustion engine 10 incorporating various features according to the present invention. As will be appreciated by those of ordinary skill in the art, engine 10 may be used in a wide variety of applications including on-highway trucks, construction equipment, marine vessels, and stationary generators, among others. Engine 10 includes a plurality of cylinders disposed below a corresponding cover, indicated generally by reference numeral 12. In a preferred embodiment, engine 10 is a multi-cylinder compression ignition internal combustion engine, such as a 4, 6, 8, 12, 16, or 24 cylinder diesel engine, for example. Moreover, it should be noted that the present invention is not limited to a particular type of engine or fuel.

Engine 10 includes an engine control module (ECM) or controller indicated generally by reference numeral 14. ECM 14 communicates with various engine sensors and actuators via associated cabling or wires, indicated generally by reference numeral 18, to control the engine. In addition, ECM 14 communicates with the engine operator using associated lights, switches, displays, and the like as illustrated in greater detail in FIG. 2. When mounted in a vehicle, engine 10 is coupled to a transmission via flywheel 16. As is well known by those in the art, many transmissions include a power take-off (PTO) configuration in which an auxiliary shaft may be connected to associated auxiliary equipment which is driven by the engine/transmission at a relatively constant rotational speed using the engine's variable speed governor (VSG). Auxiliary equipment may include hydraulic pumps for construction equipment, water pumps for fire engines, power generators, and any of a number of other rotationally driven accessories. Typically, the PTO mode is used only while the vehicle is stationary. However, the present invention is independent of the particular operation mode of the engine, or whether the vehicle is stationary or moving for those applications in which the engine is used in a vehicle having a PTO mode.

Figure 2:
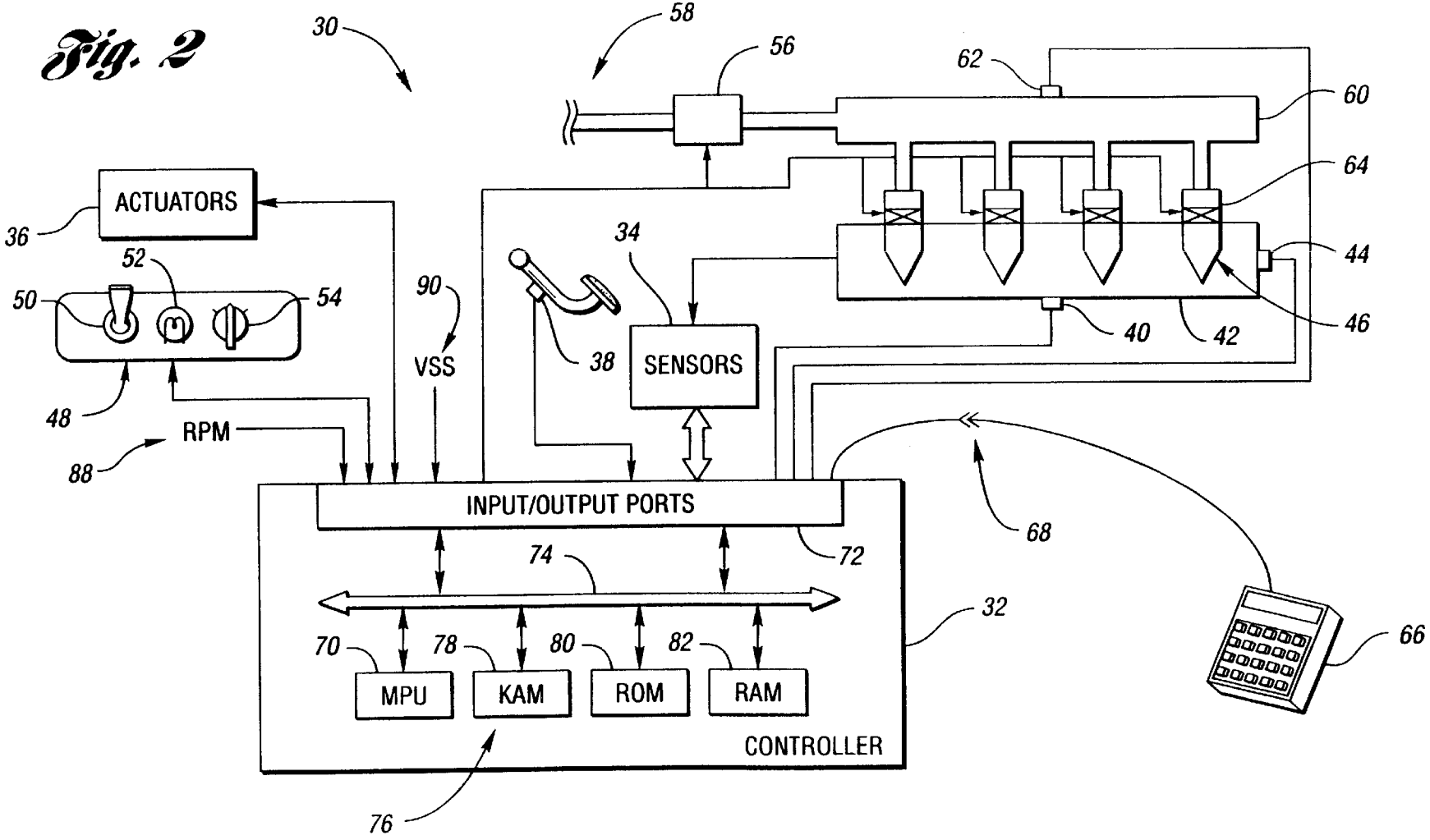
FIG. 2 is a block diagram illustrating a system for idle shutdown override with defeat protection according to the present invention.

Referring now to FIG. 2, a block diagram illustrating a system for idle shut down override with defeat protection according to the present invention is shown. System 30 represents the control system for engine 10 of FIG. 1. System 30 preferably includes a controller 32 in communication with various sensors 34 and actuators 36. Sensors 34 may include various position sensors such as an accelerator or brake position sensor 38. Likewise, sensor 34 may include a coolant temperature sensor 40 which provides an indication of the temperature of engine block 42. Likewise, an oil pressure sensor 44 is used to monitor engine operating conditions by providing an appropriate signal to controller 32. Other sensors may include rotational sensors to detect the rotational speed of the engine, such as RPM sensor 88 and a vehicle speed sensor (VSS) 90 in some applications. VSS 90 provides an indication of the rotational speed of the output shaft or tail-shaft of a transmission (not shown) which may be used to calculate the vehicle speed. VSS 90 may also represent one or more wheel speed sensors which are used in anti-lock breaking system (ABS) applications, for example.

Actuators 36 include various engine components which are operated via associated control signals from controller 32. As indicated in FIG. 2, various actuators 36 may also provide signal feedback to controller 32 relative to their operational state, in addition to feedback position or other signals used to control actuators 36. Actuators 36 preferably include a plurality of fuel injectors 46 which are controlled via associated solenoids 64 to deliver fuel to the corresponding cylinders. In one embodiment, controller 32 controls a fuel pump 56 to transfer fuel from a source 58 to a common rail or manifold 60. Operation of solenoids 64 controls delivery of the timing and duration of fuel injection as is well known in the art. While the representative control system of FIG. 2 with associated fueling subsystem illustrates the typical application environment of the present invention, the invention is not limited to any particular type of fuel or fueling system.

Sensors 34 and actuators 36 may be used to communicate status and control information to an engine operator via a console 48. Console 48 may include various switches 50 and 54 in addition to indicators 52. Console 48 is preferably positioned in close proximity to the engine operator, such as in the cab of a vehicle. Indicators 52 may include any of a number of audio and visual indicators such as lights, displays, buzzers, alarms, and the like. Preferably, one or more switches, such as switch 50 and switch 54, are used to request a particular operating mode, such as cruise control or PTO mode, for example.

In one embodiment, controller 32 includes a programmed microprocessing unit 70 in communication with the various sensors 34 and actuators 36 via input/output port 72. As is well known by those of skill in the art, input/output ports 72 provide an interface in terms of processing circuitry to condition the signals, protect controller 32, and provide appropriate signal levels depending on the particular input or output device. Processor 70 communicates with input/output ports 72 using a conventional data/address bus arrangement 74. Likewise, processor 70 communicates with various types of computer-readable storage media 76 which may include a keep-alive memory (KAM) 78, a read-only memory (ROM) 80, and a random-access memory (RAM) 82. The various types of computer-readable storage media 76 provide short-term and long-term storage of data used by controller 32 to control the engine. Computer-readable storage media 76 may be implemented by any of a number of known physical devices capable of storing data representing instructions executable by microprocessor 70. Such devices may include PROM, EPROM, BEPROM, flash memory, and the like in addition to various magnetic, optical, and combination media capable of temporary and/or permanent data storage.

Computer-readable storage media 76 include data representing program instructions (software), calibrations, operating variables, and the like used in conjunction with associated hardware to control the various systems and subsystems of the engine and/or vehicle. The engine/vehicle control logic is implemented via controller 32 based on the data stored in computer-readable storage media 76 in addition to various other electric and electronic circuits (hardware).

In one embodiment of the present invention, controller 32 includes control logic to reduce unnecessary engine idling by automatically stopping the engine while making it more difficult for an operator to defeat this feature. Control logic implemented by controller 32 monitors operating conditions of the engine and/or vehicle to determine that the vehicle is stationary. Likewise, controller 32 determines that the engine has been idling for a programmable period of time by initiating a timer/counter to track the idling time. Determining that the engine is idling may be performed in a number of manners. For example, an engine idling condition may be determined based on position of an accelerator pedal, or the engine speed being below a predetermined idle speed (which may vary according to the engine or ambient temperature). Controller 32 then determines the engine load to detect whether the engine is being used to drive an auxiliary device. Controller 32 will automatically stop the engine when the idling time exceeds a programmable limit and the engine load is less than a second programmable limit indicating the engine is not being used to drive an auxiliary device. Of course, depending upon the particular application, one or more load thresholds may be utilized to determine whether the engine is being used to drive an auxiliary device.

As used throughout the description of the invention, a selectable or programmable limit or threshold may be selected by any of a number of individuals via a programming device, such as device 66 selectively connected via an appropriate plug or connector 68 to controller 32. Rather than being primarily controlled by software, the selectable or programmable limit may also be provided by an appropriate hardware circuit having various switches, dials, and the like. Of course, the selectable or programmable limit may also be changed using a combination of software and hardware without departing from the spirit of the present invention.

As described above, compression ignition engines having an idle shut down feature have been employed to reduce the amount of unnecessary idling of the engine. Typically, the systems automatically stop the engine after a predetermined or selectable idling time to conserve fuel. However, many engine operators attempt to defeat this feature to keep the engine idling for an indefinite period of time. For example, a driver may want to keep the engine idling to avoid difficulty in restarting the engine after stopping at a rest area. As such, the driver "tricks" the engine by selecting an operating mode which does not activate or trigger the idle shut down feature. For example, an operator may select the PTO mode of operation even though the engine is not being used to drive an auxiliary load. Typically, operation in the PTO mode automatically disables the idle shut down feature of the engine. By selecting an operating mode (PTO) which is inconsistent with the current operating conditions (no auxiliary device connected), the operator has defeated the idle shut down feature. According to the present invention, controller 32 determines whether the requested operating mode is inconsistent with the current operating conditions to determine whether to automatically stop the engine. In one embodiment, engine controller 32 provides a warning to the operator to indicate that the engine will be automatically stopped. The driver is afforded a limited number of opportunities to override the automatic engine shut down. Preferably, controller 32 determines whether the requested operating mode is consistent (or inconsistent) with the current operating conditions by comparing the engine load to a selectable or programmable load threshold. If the engine is being used to drive an auxiliary device, the engine will be loaded accordingly. As such, controller 32 will override the automatic shut down feature to keep the engine running. However, if the engine operating conditions indicate that the selected mode of operation is inconsistent or inappropriate, the idle shutdown feature will be activated and the engine will be automatically stopped after the associated criteria have been satisfied, i.e. idle time, number of overrides, etc.

Figure 3:
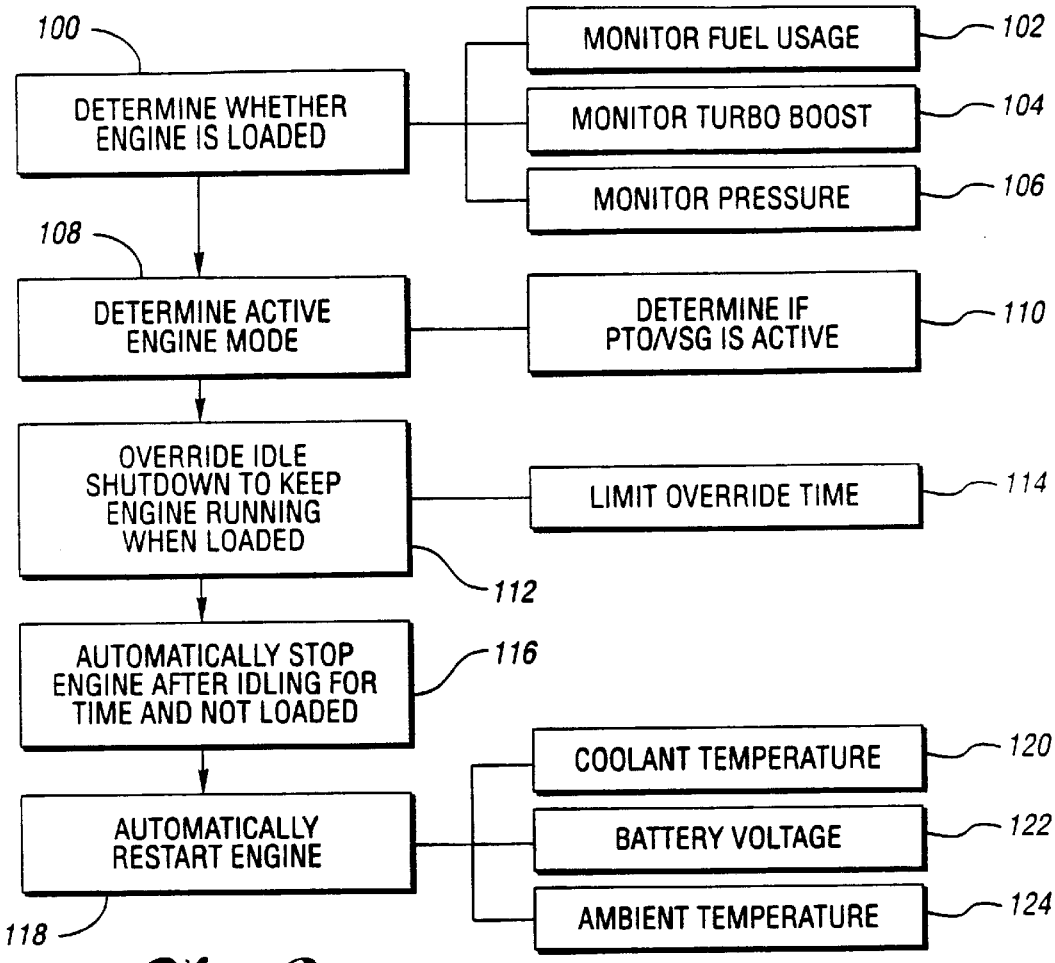
FIG. 3 is a block diagram illustrating operation of a system or method for idle shutdown override with defeat protection according to the present invention.
Figure 4:
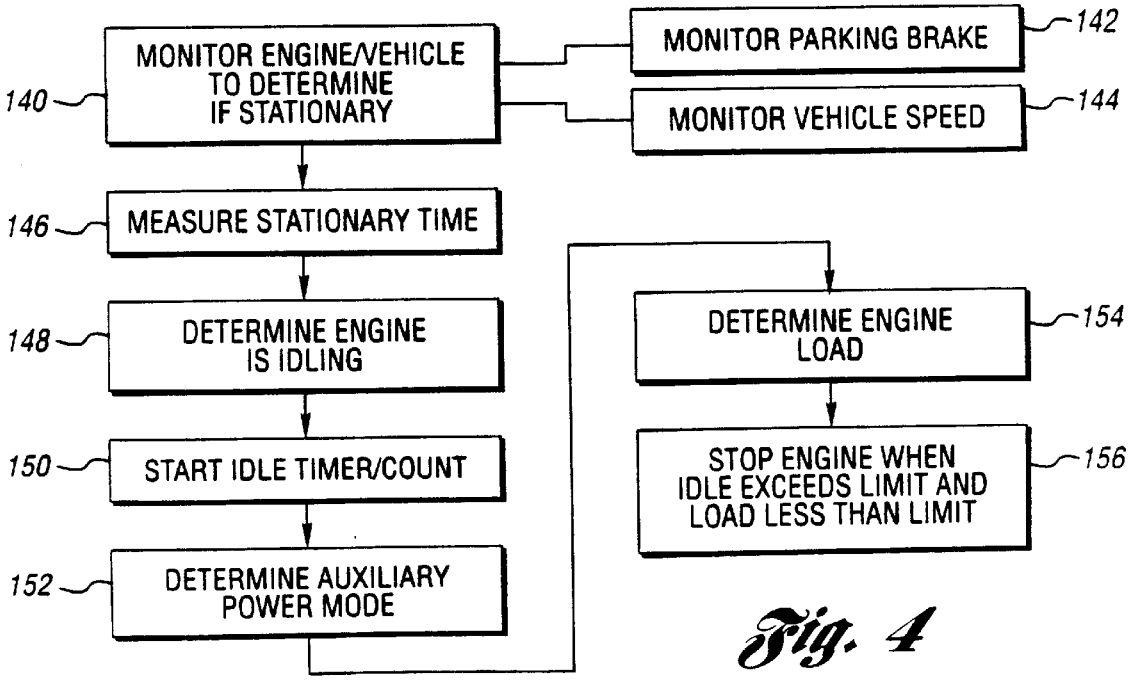
FIG. 4 is a block diagram illustrating operation of a system or method according to one alternative embodiment for idle shutdown override according to the present invention.

Referring now to FIG. 3, a block diagram illustrating operation of a system or method for idle shut down override with defeat protection according to the present invention is shown. As will be appreciated by one of ordinary skill in the art, the block diagrams of FIGS. 3 and 4 represent control logic which may be implemented or effected in hardware, software, or a combination of hardware and software. The various functions are preferably effected by a programmed microprocessor, such as included in the DDEC controller manufactured by Detroit Diesel Corporation, Detroit, Mich. Of course, control of the engine/vehicle may include one or more functions implemented by dedicated electric, electronic, or integrated circuits. As will also be appreciated by those of skill in the art, the control logic may be implemented using any of a number of known programming and processing techniques or strategies and is not limited to the order or sequence illustrated in FIGS. 3 and 4. For example, interrupt or event driven processing is typically employed in real-time control applications, such as control of an engine or vehicle. Likewise, parallel processing, multi-tasking, or multi-threaded systems and methods may be used to accomplish the objectives, features, and advantages of the present invention. The invention is independent of the particular programming language, operating system, processor, or circuitry used to develop and/or implement the control logic illustrated. Likewise, depending upon the particular programming language and processing strategy, various functions may be performed in the sequence illustrated, at substantially the same time, or in a different sequence while accomplishing the features and advantages of the present invention. The illustrated functions may be modified, or in some cases omitted, without departing from the spirit or scope of the present invention.

As shown in FIG. 3, block 100 represents a determination of whether the engine is being loaded. Any of a number of methods may be used to determine whether the engine is being loaded. For example, fuel usage may be monitored as represented by block 102. The fuel usage would then be compared to an estimated or average fuel usage for idle/unloaded operation (with unloaded operation referring to external loads considering normal parisitic loads imposed by engine driven accessories, such as the fan, A/C, etc.). A significant difference between the expected and actual fuel usage could then be used to determine whether the engine is idling. Similarly, for applications employing a turbo charger, turbo boost pressure may be monitored as indicated by block 104, with the turbocharger boost pressure exceeding a corresponding threshold indicating that the engine is being loaded. Various other engine pressures may provide an indication of whether the engine is being loaded as represented by block 106. For example, fuel pressure, cylinder pressure, coolant pressure, and the like may be monitored.

Block 108 of FIG. 3 represents determination of the active engine mode. In one embodiment, block 108 determines whether the variable-speed governor (VSG) or PTO mode is active as represented by block 110. Any operator requested mode of operation may be compared to the current engine operating conditions to determine whether it is consistent or whether the operator may be attempting to defeat the idle shut down feature through selection of an inconsistent or inappropriate operating mode.

When the engine is being loaded, such as when driving auxiliary equipment, the idle shut down feature is disabled or overridden as presented by block 112. The idle shut down override may be activated for a particular period of time as represented by block 114. Likewise, the override may continue to be in effect after the engine load has decreased to a level below the corresponding threshold, i.e. after the engine becomes unloaded. Alternatively, the override may be active for a predetermined period of time after the engine load exceeds the threshold to reduce the frequency of monitoring the engine load.

Block 116 of FIG. 3 represents automatically stopping the engine after idling for a selectable time when the engine is not being loaded, i.e. when the current engine load is below a corresponding threshold. Preferably, block 116 also provides a warning to the operator relative to the impending engine shutdown. The operator may be given an opportunity to disable the automatic shutdown for a limited period and/or a limited number of times. For example, the operator may override the engine shutdown by depressing the accelerator pedal, manipulating one or more switches, or any similar response to the warning. A timer or counter monitors the period of time since the last operator intervention before determining whether to automatically stop the engine. However, the operator may be limited to only one or two manual overrides, for example, before the engine is shut down with or without subsequent operator intervention. In this case, the operator would have to restart the engine to reset the associated idle shut down parameters.

The present invention may also include automatically restarting the engine as represented by block 118. The engine may be restarted based on the current engine and/or ambient conditions. For example, the engine may be restarted when the coolant temperature reaches a predetermined threshold as represented by block 120. Likewise, if battery voltage drops below a corresponding threshold, represented by block 122, the engine may be restarted to recharge the battery. Similarly, if the ambient temperature (inside or outside of the vehicle) drops below a selectable threshold, the engine may be automatically restarted as represented by block 124.

FIG. 4 is a block diagram illustrating an alternative implementation of an idle shutdown override with defeat protection according to the present invention. The engine/vehicle conditions are monitored to determine if the vehicle is stationary as represented by block 140. This may include determining whether a parking brake is set as represented by block 142. Likewise, the vehicle speed may be determined as represented by block 144. Determination of the vehicle speed may be performed utilizing a vehicle speed sensor which detects rotational speed of a vehicle transmission output shaft or tailshaft as is well known in the art. Likewise, one or more wheel speed sensors may be used to provide an indication of the current vehicle speed. The vehicle is determined to be stationary if the vehicle speed is below a corresponding threshold. The vehicle speed threshold may be 3 mph, for example. The amount of time that the vehicle is stationary may be determined as represented by block 146. Preferably, the idle shutdown does not occur until the vehicle is stationary for a predetermined period of time. Block 148 determines whether the engine is idling. This may be performed using any of a number of various engine operating condition sensors as known by those with skill in the art. An idle time/counter is initiated as represented by block 150. The time/counter provides an indication of the period of time that the engine has been idling.

Block 152 of FIG. 4 represents determining the current operating mode or requested operating mode for the engine. The requested operating mode may or may not be consistent with the current operating conditions of the engine as described above. Block 152 may determine the requested operating mode based on various operator inputs, such as switches, dials, push buttons, and the like. The current engine load is determined as represented by block 154. When the idle time exceeds a corresponding limit based on block 150, and the load determined in block 154 is less than its corresponding limit, the engine is automatically stopped as represented by block 156. As in the embodiments illustrated and described with reference to FIG. 3, block 156 may include providing the operator a warning signal prior to automatically stopping the engine. The warning signal may be any visual, audible, or tactile warning, such as vibration, for example.

Thus, the present invention provides a system and method for idle shutdown with defeat protection which makes it more difficult for an operator to use the engine improperly. The present invention determines the current engine load prior to overriding the idle shutdown feature so that the engine is not unintentionally shut down. The invention effectively determines whether the requested operating mode is consistent with the current operating conditions. If the engine controller determines the current operating conditions are inconsistent with the selected operating mode, the engine can be automatically stopped based on the idle time. After being automatically shut down, the engine may be automatically restarted based on various parameters, such as coolant temperature, battery voltage, and the like. As such, the present invention makes it more difficult for operators to defeat the idle shutdown feature and keep the engine running by selecting an operating mode, such as PTO, which would otherwise override the idle shutdown feature, unless the engine operating conditions indicate the mode selection is proper.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for controlling an engine having an electronic control module with an idle shutdown feature to automatically stop the engine after idling for a period of time, the method comprising:

determining whether the engine is operating in power take-off mode;

determining whether the engine is being loaded; and overriding the idle shutdown feature to keep the engine running when the engine is being loaded wherein overriding the idle shutdown is performed only when the engine is operating in power take-off mode and when the engine is being loaded.

2. The method of claim 1 wherein overriding the idle shutdown feature comprises overriding the idle shutdown feature for a predetermined period of time after determining the engine is being loaded.

3. The method of claim 1 wherein overriding the idle shutdown feature comprises continuing to override the idle shutdown feature for a period of time after determining that the engine is not being loaded.

4. The method of claim 1 wherein determining whether the engine is being loaded comprises monitoring fuel usage.

5. The method of claim 1 wherein determining whether the engine is being loaded comprises monitoring pressure.

6. The method of claim 5 wherein determining whether the engine is being loaded comprises monitoring turbocharger boost pressure.

7. The method of claim 1 further comprising determining the engine is operating using a variable speed governor wherein overriding the idle shutdown is performed only when using the variable speed governor and when the engine is being loaded.

8. The method of claim 1 further comprising:

automatically stopping the engine after the engine has been idling for a predetermined period of time and the engine is not being loaded.

9. The method of claim 8 further comprising:

automatically restarting the engine based on engine coolant temperature being below a threshold temperature.

10. The method of claim 8 further comprising:

automatically restarting the engine based on battery voltage being below a threshold voltage.

11. The method of claim 8 further comprising:

automatically restarting the engine based on ambient temperature being above a threshold ambient temperature.

12. The method of claim 8 further comprising:

automatically restarting the engine based on ambient temperature being below a threshold ambient temperature.

13. A method for controlling an engine, the method comprising:

determining whether the engine is idling;

determining whether the engine is operating in power take-off mode;

determining engine load; and automatically stopping the engine after idling for a selectable time only if the engine load is less than a corresponding threshold wherein stopping the engine is performed only when the engine operating in power take-off mode and when the engine is being loaded.

14. The method of claim 13 wherein the engine is installed in a vehicle, the method further comprising determining whether the vehicle is stationary and automatically stopping the engine only if the vehicle is stationary for a selectable time.

15. The method of claim 14 wherein determining whether the vehicle is stationary comprises determining whether a parking brake is engaged.

16. The method of claim 15 wherein determining whether the vehicle is stationary comprises monitoring vehicle speed and determining vehicle speed is below a corresponding threshold.

17. A method for reducing tampering with engine features designed to improve fuel economy in an electronically controlled compression ignition internal combustion engine, the method comprising:

monitoring current engine operating conditions to determine whether an operator selected engine operating mode is consistent with current engine operating conditions.

18. The method of claim 17 wherein monitoring current engine operating conditions comprises monitoring engine load.

19. The method of claim 18 further comprising comparing current engine load to a programmable threshold to determine whether the selected engine operating mode is consistent with current operating conditions.

20. The method of claim 18 further comprising automatically stopping the engine if the current engine operating conditions are determined to be inconsistent with the operator selected engine operating mode.

21. The method of claim 20 wherein the engine is in a vehicle and wherein automatically stopping the engine is performed only if vehicle speed is below a corresponding threshold.

22. The method of claim 17 wherein the operator selected operating mode results in operation of the engine using a variable speed governor to control engine speed:

determining whether the engine is idling;

determining engine load; and automatically stopping the engine after idling for a selectable time only if the engine load is less than a corresponding threshold.

23. A system for controlling a compression ignition internal combustion engine, the system comprising an electronic control module having an idle shutdown feature to automatically stop the engine after idling for a period of time, wherein the electronic control module determines whether the engine is being loaded and whether the engine is operating in power take-off mode, and overrides the idle shutdown feature to keep the engine running when the engine is being loaded and overriding the idle shutdown is performed only when the engine is operating in power take-off mode and when the engine is being loaded.

24. A system for reducing tampering with engine features designed to improve fuel economy in an electronically controlled compression ignition internal combustion engine, the system comprising:

an engine controller having program instructions for monitoring current engine operating conditions to determine whether an operator selected engine operating mode is consistent with current engine operating conditions.

25. A computer readable storage medium having stored data representing instructions executable by a computer for controlling an engine having an idle shutdown feature to automatically stop the engine after idling for a period of time, the computer readable storage medium comprising:

instructions for determining whether the engine is operating in power take-off mode;

instructions for determining whether the engine is being loaded; and instructions for overriding the idle shutdown feature to keep the engine running when the engine is being loaded wherein overriding the idle shutdown is performed only when the engine is operating in power take-off mode and when the engine is being loaded.

26. The computer readable storage medium of claim 25 wherein the instructions for overriding the idle shutdown feature comprise instructions for overriding the idle shutdown feature for a predetermined period of time after determining the engine is being loaded.

27. The computer readable storage medium of claim 25 wherein the instructions for overriding the idle shutdown feature comprise instructions for continuing to override the idle shutdown feature for a period of time after determining that the engine is not being loaded.

28. The computer readable storage medium of claim 25 wherein the instructions for determining whether the engine is being loaded comprise instructions for monitoring fuel usage.

29. The computer readable storage medium of claim 25 wherein the instructions for determining whether the engine is being loaded comprise instructions for monitoring pressure.

30. The computer readable storage medium of claim 25 wherein the instructions for determining whether the engine is being loaded comprise instructions for monitoring turbocharger boost pressure.

31. The computer readable storage medium of claim 25 further comprising instructions for determining the engine is operating using a variable speed governor wherein overriding the idle shutdown is performed only when using the variable speed governor and when the engine is being loaded.

32. The computer readable storage medium of claim 25 further comprising:

instructions for automatically stopping the engine after the engine has been idling for a predetermined period of time and the engine is not being loaded.

33. The computer readable storage medium of claim 32 further comprising:

instructions for automatically restarting the engine based on engine coolant temperature being below a threshold temperature.

34. The computer readable storage medium of claim 32 further comprising:

instructions for automatically restarting the engine based on battery voltage being below a threshold voltage.

35. The computer readable storage medium of claim 32 further comprising:

instructions for automatically restarting the engine based on ambient temperature being above a threshold ambient temperature.

36. The computer readable storage medium of claim 32 further comprising:

instructions for automatically restarting the engine based on ambient temperature being below a threshold ambient temperature.

37. A system for controlling an engine having an electronic control module with an idle shutdown feature to automatically stop the engine after idling for a period of time, the system comprising:

means for determining whether the engine is operating in power take-off mode;

means for determining whether the engine is being loaded; and means for overriding the idle shutdown feature to keep the engine running when the engine is being loaded wherein overriding the idle shutdown is performed only when the engine is operating in power take-off mode and when the engine is being loaded.

38. A system for controlling an engine, the system comprising:

means for determining whether the engine is idling;

means for determining whether the engine is in power take-off mode;

means for determining engine load; and means for automatically stopping the engine after idling for a selectable time only if the engine load is less than a corresponding threshold wherein the stopping is performed only when the engine is operating in power take-off mode and when the engine is being loaded.

39. A system for reducing tampering with engine features designed to improve fuel economy in an electronically controlled compression ignition internal combustion engine, the system comprising:

means for monitoring current engine operating conditions; and means for determining whether an operator selected engine operating mode is consistent with the current engine operating conditions.

* * * * *